US006982652B2

(12) United States Patent
Laird et al.

(10) Patent No.: US 6,982,652 B2
(45) Date of Patent: Jan. 3, 2006

(54) MOVABLE BARRIER OPERATOR WITH MULTIPLE LIGHTING SCHEMES AND METHOD

(75) Inventors: Edward T. Laird, Lombard, IL (US); James J. Fitzgibbon, Batavia, IL (US); Dana M. Brad, Frankfort, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 518 days.

(21) Appl. No.: 10/145,382

(22) Filed: May 14, 2002

(65) Prior Publication Data

US 2003/0214806 A1 Nov. 20, 2003

(51) Int. Cl.
*G08G 1/07* (2006.01)

(52) U.S. Cl. ..... 340/908.1; 340/468; 340/545.1; 340/825.69; 340/825.72; 340/5.71; 362/228; 362/233; 362/251

(58) Field of Classification Search ..... 340/908.1, 340/468, 686.1, 545.1, 825.69, 825.72, 5.71; 362/228, 233, 251

See application file for complete search history.

(56) References Cited

U.S. PATENT DOCUMENTS

| | | | | |
|---|---|---|---|---|
| 4,549,092 | A | 10/1985 | Matsuoka et al. | |
| 5,576,701 | A * | 11/1996 | Heitschel et al. | 340/5.31 |
| 5,589,747 | A * | 12/1996 | Utke | 318/468 |
| 6,326,754 | B1 * | 12/2001 | Mullet et al. | 318/480 |
| 6,486,795 | B1 | 11/2002 | Sobel et al. | |
| 6,495,821 | B1 | 12/2002 | Smith et al. | |
| 6,522,258 | B1 * | 2/2003 | Lott | 340/686.1 |
| 6,737,968 | B1 * | 5/2004 | Ergun et al. | 340/540 |

OTHER PUBLICATIONS

International Search Report for PCT patent application PCT/US03/14502 completed mailed on Sep. 10, 2003.
International Application No. PCT/US01/11348, published Oct. 25, 2001.

* cited by examiner

*Primary Examiner*—Daniel Wu
*Assistant Examiner*—Tai T. Nguyen
(74) *Attorney, Agent, or Firm*—Fitch, Even, Tabin & Flannery

(57) ABSTRACT

A movable barrier operator (10) can control a plurality of light sources (12) via corresponding light drivers (11) to effect various lighting schemes in response to facilitating various operating modes and/or operational states of the operator. Preferably such lighting schemes are both selectively assignable by a user to specific modes/states and themselves uniquely definable by a user.

21 Claims, 3 Drawing Sheets

MOVABLE BARRIER OPERATOR WITH MULTIPLE LIGHTING SCHEMES AND METHOD

TECHNICAL FIELD

This invention relates generally to movable barrier operators.

BACKGROUND

Movable barrier operators are well known in the art. Such mechanisms typically serve to use an electric motor to selectively move a movable barrier between open and closed positions. Such operators often have lighting associated therewith, either integral to the operator housing or physically separated from the operator housing. Many times such lighting will be activated by the operator for the duration of moving the movable barrier from one position to another plus some set period of time thereafter (such as four and one half minutes).

Such prior art solutions are adequate for some applications. There are, however, situations where such solutions are not fully suitable. For example, using the same amount of time to maintain the light in an illuminated state regardless of whether the movable barrier has just closed or just opened constitutes a compromise representing an average solution. Furthermore, present designs usually offer only a fixed selection of lights and a fixed orientation of those lights. Again, such designs are oriented towards satisfying a sense of average demand and not the specific needs of a specific user. Also, such prior art movable barrier operators typically provide a fixed lighting scheme; that is, regardless of what options may otherwise be available, the lights tend to illuminate and extinguish in accordance with an original built-in lighting scheme and offer little user opportunity to customize the scheme in any way.

BRIEF DESCRIPTION OF THE DRAWINGS

The above needs are at least partially met through provision of the movable barrier operator with multiple lighting schemes and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a movable barrier operator is configured to have a plurality of ambient light drivers (such that lights can be operably coupled to the drivers to facilitate control of the lights via the movable barrier operator). In general, the movable barrier operator can operate in at least two modes of operation. When operating in a first mode of operation, the operator controls the ambient lights using a first control scheme. When operating in a second mode of operation, the operator controls the ambient lights using a second control scheme. The first and second control schemes are different from one another.

For example, the number of lights used for each mode of operation can be varied and/or the manner of use can be varied for some or all of the lights as used during each mode of operation. In a preferred embodiment, the user has an ability to readily select particular variations to thereby allow the user to customize the lighting functionality to accommodate a specific installation. In some embodiments, the mode of operation itself can vary to accommodate corresponding operational states of the movable barrier operator. This additional flexibility offers an even greater range of customization to the user.

Figure 1:
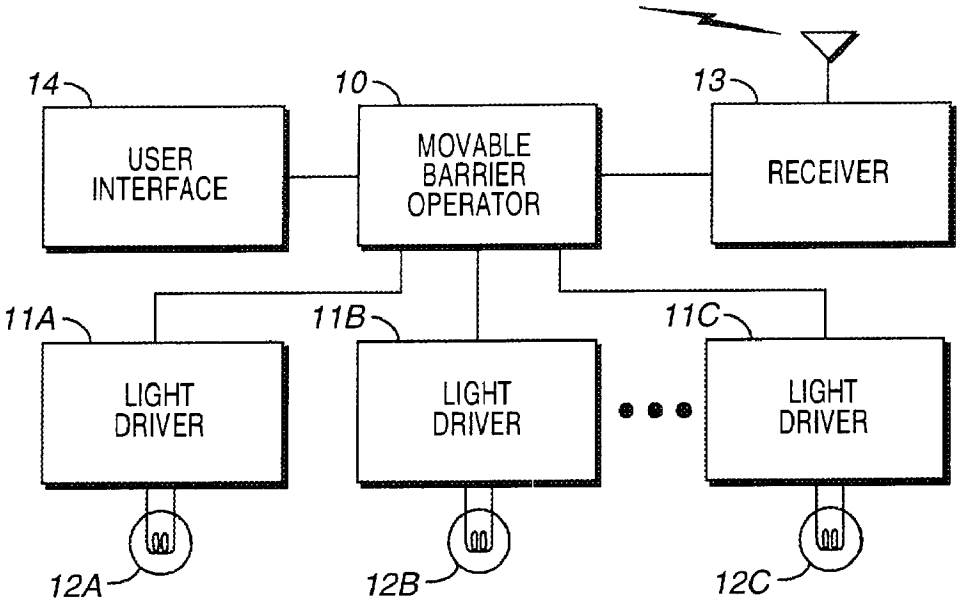
FIG. 1 comprises a block diagram as configured in accordance with an embodiment of the invention.

Referring now to FIG. 1, a movable barrier operator 10 comprises a programmable platform as well understood in the art. Being programmable, the operator 10 can be readily modified to accommodate the functionality described herein. In this embodiment, a plurality of light drivers 11A through 11C are operably coupled to the movable barrier operator 10. In particular, the drivers 11A–11C have their actuation inputs coupled to corresponding outputs of the operator 10. So configured, the operator 10 can actuate and switch off individual any of the light drivers 11A–11C. Such light drivers are well understood in the art and include silicon controlled rectifier circuits, triac circuits, relay-based circuits and so forth; these drivers essentially serve to switch high voltage alternating current (such as 120 V AC) in response to low level direct current signals as typically provided by the logic circuits of a movable barrier operator. Given the relative familiarity of those skilled in the art with such drivers, additional detail will not be provided here for the sake of brevity and the preservation of focus.

In this embodiment, each light driver 11A–11C couples individually to a corresponding ambient light source 12A–12C, again as well understood in the art. Such light sources serve to provide ambient light to nearby surroundings (as versus, for example, merely serving to provide user-discernable signaling as occurs with light sources such as light emitting diodes). Various light sources can be successfully used herein, including incandescent, fluorescent, mercury vapor, sodium filament, and other as well. In addition, though only one light source is shown in this embodiment as being connected to a given light driver, if desired, additional light sources can be coupled to any given light driver as may be appropriate to a given application. In addition, as depicted, only three light drivers 11A–11C are coupled to the movable barrier operator. If desired, additional (or fewer) light drivers can be used as appropriate.

In this embodiment, a wireless receiver 13 and a user interface 14 are also coupled to the movable barrier operator 10. The wireless receiver 13 can be a typical movable barrier operator wireless receiver that receives appropriately modulated radio frequency signals that can include transmitter identification and/or user instructions regarding desired operation of the operator 10 and a corresponding movable barrier. Such a receiver 13 can also be used to support other functionality as described below in more detail. The user interface 14 can be as simple as a single switch or dual inline package switch (a so-called DIP switch) or as complex as a keypad, touchscreen display, or voice recognition mechanism as befits the needs of a given application. In at least some of the embodiments described below, this user interface 14 can serve to facilitate selection and/or programming of specific ambient light control schemes.

Figure 2:
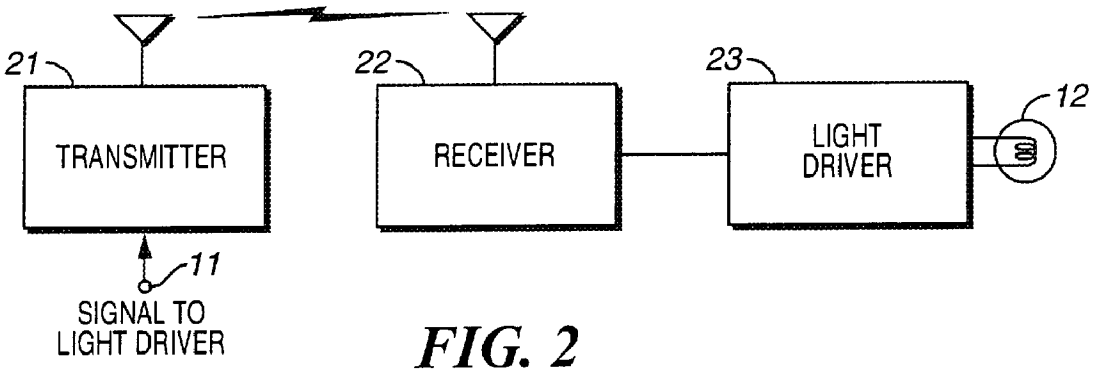
FIG. 2 comprises a detail block diagram as configured in accordance with another embodiment of the invention.

As depicted, the light drivers 11A–11C are all physically coupled to the movable barrier operator 10. Such an arrangement represents a fairly typical mode of installation. If desired, however, and referring now to FIG. 2, any given light driver signal 11 can be coupled to a transmitter 21 that transmits control signaling to a corresponding light source 12 via a wireless receiver 22 that controls a light driver 23 that is coupled to the light source 12. With such an arrangement, the movable barrier operator 10 can control light sources that are otherwise difficult to physically couple to the operator 10 (such a circumstance can arise, for example, when retrofitting an installed movable barrier operator with additional light sources that are oriented at some distance from the operator).

So configured, the movable barrier operator 10 can receive user instructions via wireless signals or via the user interface 14. Such instructions can facilitate desired operation of the various ambient light sources 12A–12C that are under the control of the movable barrier operator 10 as described below in more detail.

Figure 3:
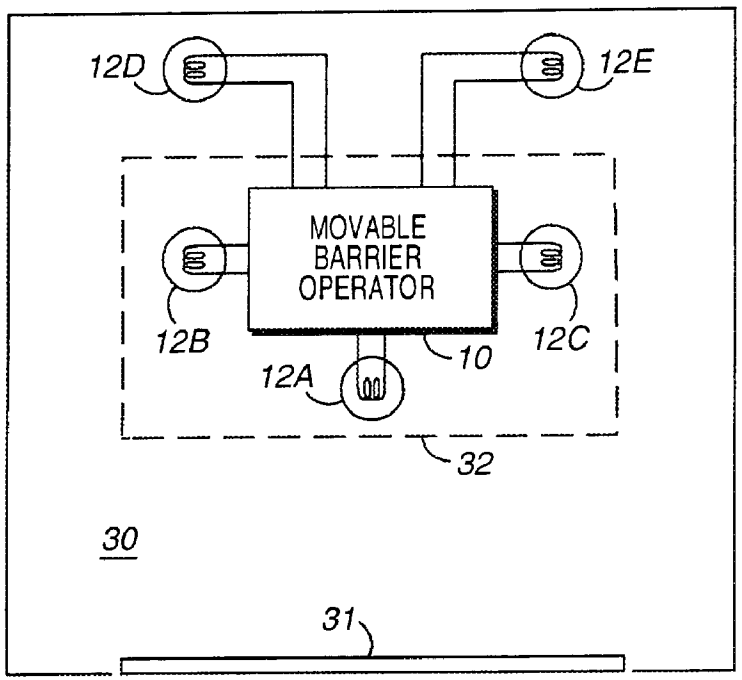
FIG. 3 comprises a top plan block diagram as configured in accordance with various embodiments of the invention.

Referring now to FIG. 3, a non-exhaustive illustrative example depicts a garage 30 having a movable barrier 31 comprising, in this example, a garage door. The movable barrier 31 can be moved between opened and closed positions by a motor and corresponding drive mechanism (not shown) as well understood in the art The motor in turn is controlled by a movable barrier operator 10 that is installed within the garage 30 (often through mounting on the ceiling of the garage 30). In this embodiment there are five light sources 12A–12E that are coupled to the operator 10 via corresponding light drivers (as otherwise described with reference to FIG. 1 but not shown here for purposes of clarity). Three of the light sources 12A–12C are disposed within a housing 32 that contains at least a majority of the movable barrier operator 10 and two of the light sources 12D and 12E are located to the exterior of the housing 32. For example, one light source 12A can be disposed underneath the operator housing 32 to provide lighting directly below the housing. The other two housing-mounted light sources 12B and 12C can be side mounted to direct lighting from the approximate center of the garage 30 towards each of the individual parking positions therein (appropriate reflectors and/or lenses can of course be utilized to shape, diffuse, and direct such lighting as desired and as well understood in the art). The remaining two light sources 12D and 12E can be mounted on the ceiling of the garage 30 distal from the operator housing 32 and over a forward portion of the two parking positions to thereby, for example, improve illumination of the forward area where a user will park their vehicle.

It should be understood that this embodiment presents only one possible configuration for illustrative purposes only. Fewer or greater numbers of light sources could be used, either in a housing-mounted form factor or as separate outboard elements. In addition, light sources could also be disposed outside the garage 30 as desired.

Pursuant to the embodiment presented below, the operator 10 can control these various lights in various ways depending upon the specific operational mode and/or operational state of the movable barrier operator 10. A few examples in this regard are as follows:

EXAMPLE 1

When the movable barrier operator 10 is placed into an OPEN mode of operation, the operator 10 could activate all of the light sources 12A–12E. When the movable barrier operator 10 is placed in a CLOSE mode of operation, however, the operator 10 could instead activate only a single light source (such as the centrally positioned housing-mounted light source 12A).

EXAMPLE 2

When the movable barrier operator 10 receives either an OPEN or CLOSE command via a wireless instruction from a specific user's remote transmitter (as is well understood in the art), the operator 10 can identify the user via the unique identification code that accompanies the command. By pre-assigning a specific side of the garage 30 to this specific user (for example, the right side of the garage 30 could be pre-assigned to the specific individual), the operator 10 can use this information to cause the corresponding light sources 12C and 12E for that side of the garage 30 to illuminate for the benefit of that specific user. Conversely, when a command is received from a second user who uses the left side of the garage 30, only the light sources 12B and 12D are illuminated.

EXAMPLE 3

When a wireless-based command is received, the movable barrier operator 10 will effect the command while causing illumination of only three of the light sources 12A, 12D, and 12E. When a user provides a command through a user interface switch 14, however, the movable barrier operator 10 will effect the command while causing illumination of all five light sources 12A–12E.

It should be clear that the movable barrier operator 10 can effect various lighting operational schemes to accommodate various operating modes and operational states. Such capability can be inflexibly programmed into the movable barrier operator 10 during manufacturing such that the operator 10 will always respond the same way to such stimuli. In a preferred embodiment, however, the operator's programmability is leveraged to at least permit a user to themselves associate a given lighting operational scheme (from amongst a plurality of such schemes) with a given operational mode or state and preferably to permit user programming of unique lighting operational schemes themselves.

Figure 4:
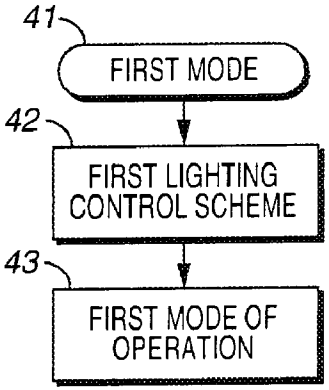
FIG. 4 comprises a flow diagram as configured in accordance with an embodiment of the invention.
Figure 5:
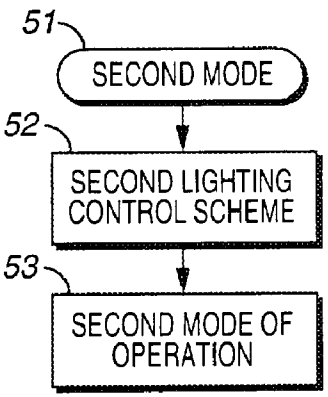
FIG. 5 comprises a flow diagram as configured in accordance with an embodiment of the invention.

With reference to FIG. 4, it should be clear that the movable barrier operator 10 functions, when implementing 41 a first mode of operation, will effect 42 a first lighting control scheme when facilitating 43 a first mode of operation. Similarly, and referring now to FIG. 5, the movable barrier operator 10 will, when operating 51 in a second mode of operation, effect 52 a second lighting control scheme when facilitating 53 a second mode of operation. As noted above, the various modes of operation can relate to specific actions of the operator (such as opening the movable barrier, closing the movable barrier, reversing movement of the movable barrier in response to detecting an obstacle, and so forth). It is also possible to correlate specific light schemes, however, with operational states of the movable barrier operator as well.

Figure 6:
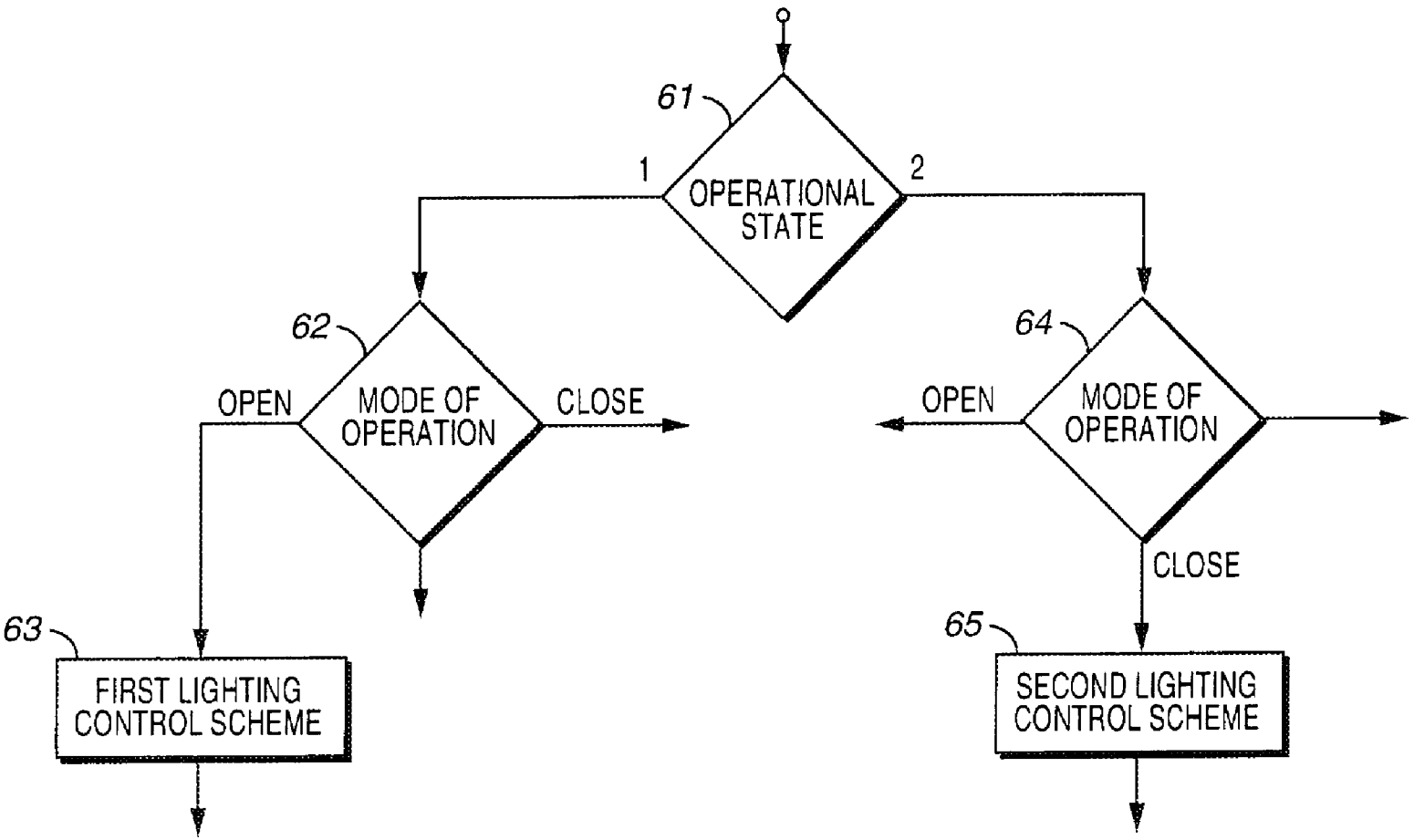
FIG. 6 comprises a flow diagram as configured in accordance with an embodiment of the invention.

For example, and referring now to FIG. 6, the movable barrier operator 10 can detect 61 when either of two operational states 1 and 2 has been selected (for purposes of this example, the first operational state can be engaged when a first user transmits a command in conjunction with their unique identification code and the second operational state can be engaged when a second user transmits a command in conjunction with their unique identification code). When a first operational state is detected (for example, when the first user has used their wireless remote to transmit an OPEN command to the movable barrier operator 10), the operator 10 can then determine 62 a specific mode of operation as selected by the user (in this example, the mode of operation would be the OPEN mode of operation). The operator 10 would then implement 63 a corresponding first lighting control scheme (in this example, when opening the movable barrier for the first user, perhaps only two specific light sources are illuminated).

To continue this example, when the operational state is determined 61 to instead reflect reception of a wireless command from a second user, and the corresponding mode of operation is determined 64 to be the CLOSE operation, a second lighting control scheme is implemented 65 (for example, only a single light source, different than the two light sources used above, is actuated).

So configured, it should be understood that a large number of unique lighting schemes can be accommodated and correlated with various operating modes and/or operational states. Again, preferably, the movable barrier operator 10 is provided with a user interface 14 (or a sufficiently capable wireless interface) to permit a user to at least associate pre-stored lighting schemes with at least some operating modes/states and, if desired, to permit a user to specify and define custom lighting schemes to meet their specific needs.

Such a movable barrier operator 10 will support wide and varied lighting capability both at the time of installation and later (particularly as and when additional light sources are added to an existing movable barrier operator). Furthermore, such an operator 10 will readily accept alterations to whatever lighting schemes are selected. Such flexibility allows a user to modify the lighting response of the operator 10 to suit changing needs over time.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A movable barrier operator comprising a plurality of ambient light drivers, wherein the movable barrier operator has at least a first mode of operation such that the plurality of ambient light drivers are activated pursuant to a first control scheme and a second mode of operation such that the plurality of ambient light drivers are activated pursuant to a second control scheme, which second control scheme is different from the first control scheme.

2. The movable barrier operator of claim 1 wherein at least some of the plurality of ambient light drivers are coupled to separate lights.

3. The movable barrier operator of claim 1 and further comprising a housing disposed about at least a portion of the movable barrier operator, wherein at least one but not all of the plurality of ambient light drivers is operably coupled to a light that is also disposed at least partially within the housing.

4. The movable barrier operator of claim 3 wherein at least one of the plurality of ambient light drivers is operably coupled to a light that is not at least partially disposed within the housing.

5. The movable barrier operator of claim 4 wherein the light that is not at least partially disposed within the housing is operably coupled to a corresponding ambient light driver via a wired link.

6. The movable barrier operator of claim 4 wherein the light that is not at least partially disposed within the housing is operably coupled to a corresponding ambient light driver via a wireless link.

7. The movable barrier operator of claim 1 wherein the first mode of operation corresponds to a first direction of movement of a movable barrier and the second mode of operation corresponds to a second direction of movement of a movable barrier.

8. The movable barrier operator of claim 7 wherein the first direction of movement of the movable barrier comprises an opening direction of movement and the second direction of movement of the movable barrier comprises a closing direction of movement.

9. The movable barrier operator of claim 8 wherein the first mode of operation comprises activating a first group, but not all, of the plurality of ambient light drivers and wherein the second mode of operation comprises activating a second group of the plurality of ambient light drivers, wherein the first group is at least partially unique with respect to the second group.

10. The movable barrier operator of claim 8 wherein the first mode of operation comprises activating a first group of the plurality of ambient light drivers and wherein the second mode of operation comprises activating a second group, but not all, of the plurality of ambient light drivers, wherein the first group is at least partially unique with respect to the second group.

11. The movable barrier operator of claim 1 and further comprising a light operating mode user selection interface that is operably coupled to the plurality of ambient light drivers.

12. The movable barrier operator of claim 11 wherein the light operating mode user selection interface comprises at least an electrical switch.

13. The movable barrier operator of claim 11 wherein the light operating mode user selection interface comprises a wireless receiver.

14. The movable barrier operator of claim 1 and further comprising a programmable platform being programmed to control at least portions of the first and second mode of operation.

15. The movable barrier operator of claim 1 wherein the first mode of operation corresponds to operation of the movable barrier operator by a first user and the second mode of operation corresponds to operation of the movable barrier operator by a second user.

16. The movable barrier operator of claim 15 wherein the first user has a first transmission code corresponding thereto and the second user has a second transmission code corresponding thereto.

17. The movable barrier operator of claim 16 and further comprising a wireless receiver having a wireless input adapted and configured to receive the first and second transmission code and being operably coupled to the plurality of ambient light drivers.

18. A method of controlling movable barrier operator lights comprising:

automatically detecting when at least either of a first and second operational state has been selected by a user;

when the first operational state has been selected, activating at least a first one of a plurality of ambient lights pursuant to a first operational scheme in response to activation of a first mode of operation;

when the second operational state has been selected, activating at least a second one of the plurality of ambient lights pursuant to a second operational scheme in response to activation of a second mode of operation;

wherein at least one of:

the first and second one of the plurality of ambient lights;

the first and second operational scheme; and the first and second mode of operation; are different with respect to one another.

19. The method of claim 18 wherein the first and second one of the plurality of ambient lights are different with respect to one another.

20. The method of claim 18 wherein the first and second operational scheme are different with respect to one another.

21. The method of claim 18 wherein the first and second mode of operation are different with respect to one another.

* * * * *